US006012655A

United States Patent [19]

Maier

[11] Patent Number: 6,012,655

[45] Date of Patent: Jan. 11, 2000

[54] FUEL INJECTION VALVE AND METHOD OF PRODUCING THE SAME

[75] Inventor: Stefan Maier, Yokohama, Japan

[73] Assignee: Robert Bosch GmbH, Stuttgart, Germany

[21] Appl. No.: 09/029,818

[22] PCT Filed: Apr. 8, 1997

[86] PCT No.: PCT/DE97/00710

§ 371 Date: Mar. 18, 1998

§ 102(e) Date: Mar. 18, 1998

[87] PCT Pub. No.: WO98/05861

PCT Pub. Date: Feb. 12, 1998

[30] Foreign Application Priority Data

Aug. 2, 1996 [DE] Germany ..... 196 31 280

[51] Int. Cl.[7] ..... B05B 1/30

[52] U.S. Cl. ..... 239/585.4; 239/585.1; 239/533.3; 239/533.9

[58] Field of Search ..... 239/584, 585.1, 239/585.2, 585.4, 585.5, 533.3, 533.9, 533.11, 533.15

[56] References Cited

U.S. PATENT DOCUMENTS

| | | | |
|---|---|---|---|
| 4,944,486 | 7/1990 | Babitzka | 239/585.4 X |
| 4,946,107 | 8/1990 | Hunt | 239/585.4 |
| 5,046,472 | 9/1991 | Linder | 239/585.4 X |
| 5,769,391 | 6/1998 | Noller et al. | 239/585.4 X |
| 5,775,599 | 7/1998 | Smith et al. | 239/585.4 X |

FOREIGN PATENT DOCUMENTS

| | | | |
|---|---|---|---|
| 43 10 819 A1 | 10/1994 | Germany . | |
| 9105950 | 5/1991 | WIPO | 239/585.4 |

*Primary Examiner*—Andres Kashnikow
*Assistant Examiner*—Robin O. Evans
*Attorney, Agent, or Firm*—Kenyon & Kenyon

[57] ABSTRACT

A fuel injection valve for fuel injection systems of internal combustion engines is composed of two main components. An inner value part includes all the individual components that lie in the immediate flow path of the fuel while an outer plastic part is formed mainly by a solenoid subassembly and a plastic shroud. The valve part includes a thin-walled non-magnetic sleeve which is very sensitive to mechanical and chemical effects. Therefore, the valve part is manufactured and adjusted separately from the plastic part. The complete valve part is subsequently slid into a through opening of the plastic part, a connection being achieved between the plastic part and the value part by engagement, a latching or a clipping.

16 Claims, 3 Drawing Sheets

FUEL INJECTION VALVE AND METHOD OF PRODUCING THE SAME

FIELD OF THE INVENTION

The present invention relates to a fuel injection valve and a process for manufacturing a fuel injection valve, in particular a fuel injection valve that can be assembled economically in a simple manner.

An electromagnetically actuated fuel injection valve is already known from U.S. Pat. No. 4,946,107, which among other things has a non-magnetic sleeve as a connecting part between a core and a valve seat body. The sleeve is connected at both axial ends to the core and to the valve seat body. The sleeve has a constant outer diameter and a constant inner diameter over its entire axial length. The core and the valve seat body are designed with an outer diameter such that they extend into the sleeve at both ends so that the sleeve completely surrounds the two components, core and valve seat body, in these areas. In the inside of the sleeve, in the axial direction, a valve needle moves with an armature that is guided through the sleeve. The fixed connections of the sleeve with the core and the valve seat body are accomplished, e.g., by means of welding. The core and non-magnetic sleeve, together, delimit toward the outside an inner valve part, which is manufactured and adjusted separately and later forms the inside of the fuel injection valve. This inner valve part is ultimately surrounded by several other individual components in the assembled injection valve; at least one pot-shaped housing part, a solenoid with coil body, a cup-shaped coil housing and a connector part are needed. The arrangement and design of the many individual parts that surround the valve part are relatively complex. In addition, a number of connections must be made between the individual outer parts and the inner valve part.

A fuel injection valve is also known from German Patent No. DE 43 10 819, which has a non-magnetic, thin-walled sleeve as a valve seat holder. The entire, completely adjusted fuel injection valve, including the sleeve, is largely surrounded by a plastic injection-molded piece that extends outward from the core in the axial direction over the solenoid to the downstream end of the injection valve. The deep-drawn sleeve has only a very small wall thickness (<0.3 mm) in order to transfer the magnetic flux with as little loss as possible over the non-magnetic sleeve. To coat the injection valve with plastic, high extrusion-coating pressures (up to 350 bar) are required which can lead to deformation of the sleeve, causing assembly and function problems in the injection valve.

SUMMARY OF THE INVENTION

The fuel present injection valve according to the invention can be assembled economically in a simple manner. According to the present invention, this simplified assembly of the fuel injection valve is achieved in that two main components of the injection valve, a valve part and a plastic part, are manufactured and adjusted separately from each other. The inner valve part is designed in an advantageous manner with, among other things, a non-magnetic, thin-walled sleeve, the use of which affords cost savings compared to known valves based on material savings and the joining for connection of individual components can be partially eliminated. Additionally, it is advantageous that the outer plastic part has an inner opening into which the valve part can very easily be placed and fastened simply and yet securely with a holding connection.

Because of this separation into two main components, there is the special advantage that all the negative influences in the manufacturing of the plastic coating (e.g., high extrusion-coating pressures, development of heat) can be kept away from the valve components that carry out the important valve functions. This reliably prevents deformation of the thin-walled sleeve of the valve part by the extrusion-coating pressure. The relatively dirty injection process can take place, outside the assembly line for the valve part.

According to the present invention, the holding connection is produced by engagement, latching or clipping of a holding element on the plastic part into a groove on the outer circumference of the valve part. The holding elements can have various contours for this, e.g., with corners or rounded.

DETAILED DESCRIPTION

Figure 1:
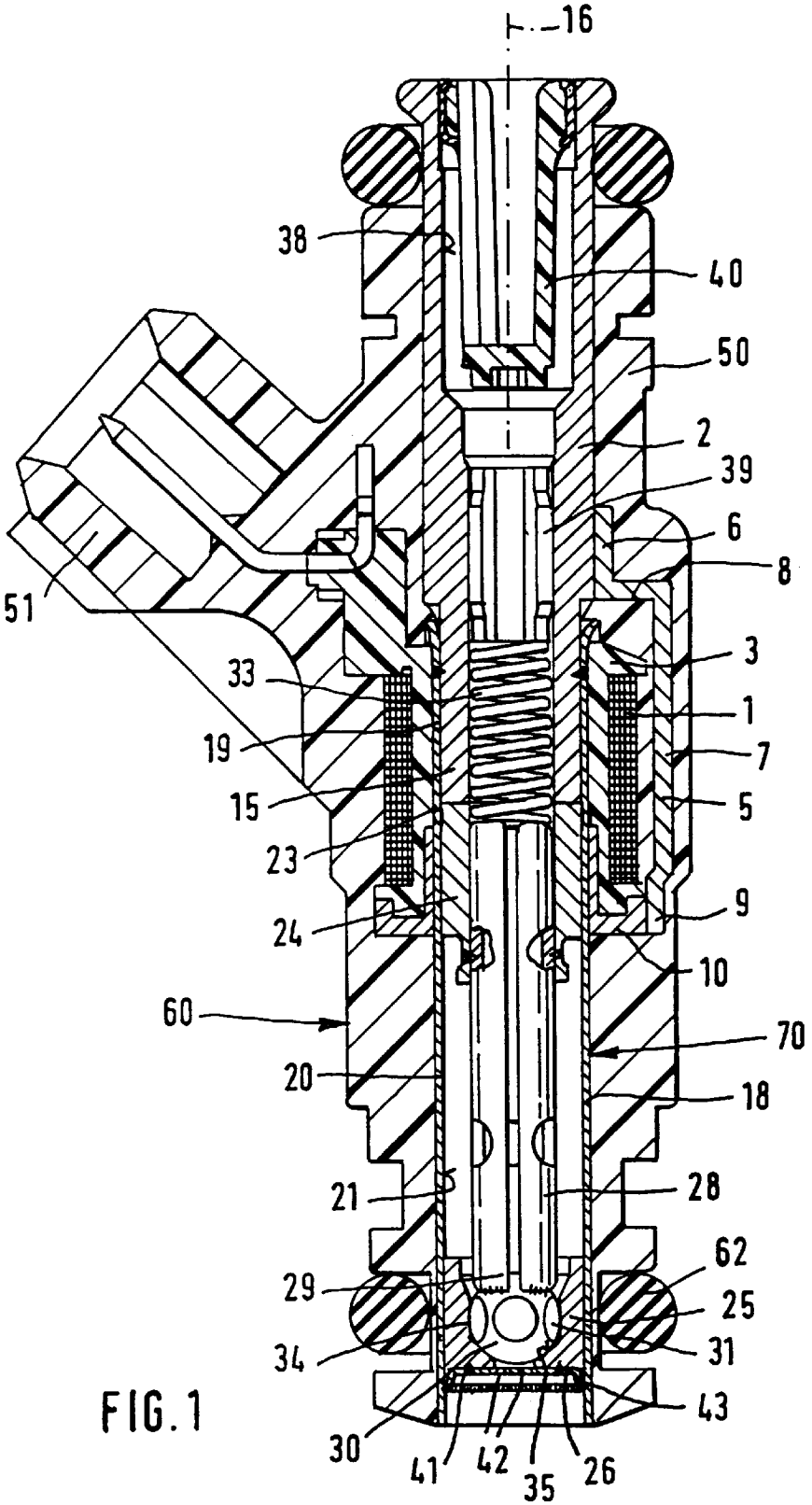
FIG. 1 shows an exemplary fuel injection valve according to the present invention.

The electromagnetically actuated valve in the form of an injection valve for fuel injection systems of mixture-compressing, externally ignited internal combustion engines shown in FIG. 1 as an example has a tube-shaped core 2 that serves as a fuel inlet pipe surrounded by solenoid 1. Coil body 3 that is stepped in the radial direction holds one winding of solenoid 1 and makes possible, in connection with core 2, a particularly compact structure of the injection valve in the area of solenoid 1. Solenoid 1 is, with its coil body 3, surrounded by at least one conductive element 5 that is designed, e.g., as a clip and serves as a ferromagnetic element, that surrounds solenoid 1 at least partially in the circumferential direction and contacts core 2 with its upper end 6. The at least one conductive element 5 is stepped in such a way that main section 7 running parallel to the axis and upper end 6 are connected through connecting section 8 that runs radially. Connecting section 8 represents an upper cover of the solenoid area. To close the magnetic circuit, conductive element 5 is connected at its lower end 9, e.g., with conductive ring 10 that is L-shaped in cross section with one or more weld points, which represents the downward limitation of the solenoid area in the downstream direction. Conductive element 5 and conductive ring 10, that conduct the magnetic flux, surround solenoid 1 that is wound around coil body 3 at least partially in a pot shape.

With one lower core end 15 of core 2, that has a somewhat smaller outer diameter than the supply-side, upper end of core 2 that serves as the fuel inlet, a tube-shaped and thin-walled sleeve 18 is connected tightly as a connecting part, for example by welding, and surrounds core end 15 partially in the axial direction with an upper sleeve section 19. Coil body 3 extends beyond upper sleeve section 19 of upper sleeve 18 at least partially in the axial direction. Coil body 3 namely has a larger inner diameter over its entire axial extension than the diameter of sleeve 18 in its upper sleeve section 19. The tubeshaped sleeve 18 made of, e.g., non-magnetic steel, extends downstream with lower sleeve section 20 to the downstream end of the fuel injection valve, lower sleeve section 20 having a slightly smaller diameter than the diameter of upper sleeve section 19. The diameter reduction in the form of a small shoulder 23 is located in the area of the upper end of conductive ring 10, since conductive ring 10 has a minimally smaller inner diameter than the inner diameter of coil body 3. This design contributes to reliable assembly of the injection valve, which will be described below in detail.

The sleeve 18 is thus formed with a tube shape over its entire axial length. Sleeve 18 forms through opening 21 over its entire axial extension with a largely constant diameter, except for shoulder 23, which runs concentrically to the valve longitudinal axis. With the sleeve section following downstream from its shoulder 23, sleeve 18 surrounds armature 24 and further downward valve seat body 25. Injection hole disk 26 that is tightly connected to valve seat body 25, e.g., with a pot shape, at its lower front downstream side, is surrounded in the circumferential direction by the sleeve, the tight connection of valve seat body 25 and injection hole disk 26 being implemented, e.g., by a surrounding sealed weld seam. Sleeve 18 is not only a connecting part but also fulfills holding and bearing functions, in particular for valve seat body 25 so that sleeve 18 is actually also a valve seat carrier. In through opening 21, e.g., tube-shaped valve needle 28 is mounted which, on its downstream end 29 facing injection hole disk 26, is connected, e.g., by welding to an, e.g., ball-shaped valve closing body 30, on the circumference of which there are, e.g., five flat regions 31 for the fuel to be injected to flow past.

The injection valve is actuated electromagnetically, in a known way. The electromagnetic circuit with solenoid 1, core 2, at least one conductive element 5, conductive ring 10 and armature 24 are used for axial movement of valve needle 28 and thus for opening the injection valve in opposition to the spring force of restoring spring 33 and/or closing of the injection valve. Armature 24 is connected to the end of valve needle 28 facing away from valve closing body 30, e.g., with a weld seam and aligned to core 2. Guide opening 34 of valve seat body 25 is used to guide valve closing body 30 during the axial movement of valve needle 28 with armature 24 along valve longitudinal axis 16. In addition, armature 24 is guided in sleeve 18 during the axial movement.

Ball-shaped valve closing body 30 works together with valve seat surface 35 of valve seat body 25, which decreases in the flow direction in a truncated cone shape, which is formed in an axial direction downstream by guide opening 34. The pot-shaped injection hole disk 26 has, in addition to base part 41, on which valve seat body 25 is fastened and in which there is at least one, but for example four injection openings 42 that are formed by erosion or punching, and a surrounding downstream retaining edge 43. Retaining edge 43 is bent conically outward in the downstream direction so that it contacts the inner wall defined by sleeve 18 formed by through opening 21 whereby radial pressure is created. At the downstream end, retaining edge 43 of injection hole disk 26 is connected to the wall of sleeve 18, for example by a surrounding tight weld seam formed, e.g., by means of a laser. Direct flow of the fuel into an intake line of the internal combustion engine outside injection openings 42 is prevented by weld seams on injection hole disk 26.

The insertion depth of valve seat body 25 with injection hole disk 26 in sleeve 18, among other things, determines the stroke of valve needle 28. In this process, one end position of valve needle 28 is determined, when the solenoid is not excited, by the contact of valve closing body 30 on valve seating surface 35 of the valve seating body 25, while the other end position of valve needle 28, when solenoid 1 is excited, results by contact of armature 24 on core end 15. In addition, stroke adjustment occurs by axial displacement of core 2, which is pressed in with slight excess dimension in upper sleeve section 19 of sleeve 18. Core 2 is then connected tightly to sleeve 18 in the desired position; laser welding on the circumference of sleeve 18 is recommended. The joining can also be performed by press fit if the excess is selected sufficiently large so that the forces that occur can be absorbed and complete sealing is guaranteed, whereby welding can be omitted.

Adjusting sleeve 39 is slid into stepped flow hole 38 of core 2 that runs concentrically to the valve longitudinal axis which serves for supply of fuel in the direction of the valve seat, especially valve seat surface 35. Adjusting sleeve 39 is used to adjust the spring prestress of restoring spring 33 that contacts adjusting sleeve 39 which in turn is supported with its opposite side on valve needle 28. Fuel filter 40 extends into flow hole 38 of core 2 on its supply-side end and provides for filtering out any fuel components which could cause clogging of or damage to the injection valve because of their size.

The adjusted and assembled injection valve is largely surrounded by a plastic shroud 50, which extends outward from core 2 in the axial direction over solenoid 1 to the downstream end of sleeve 18, and includes an electrical connector 51 that is also injection-molded. Solenoid 1 is electrically contacted and thus excited by way of electrical connector 51. As FIG. 2 shows, plastic shroud 50 is a tube-shaped plastic part which differs considerably from the plastic extrusion coatings of the known fuel injection valves.

Figure 2:
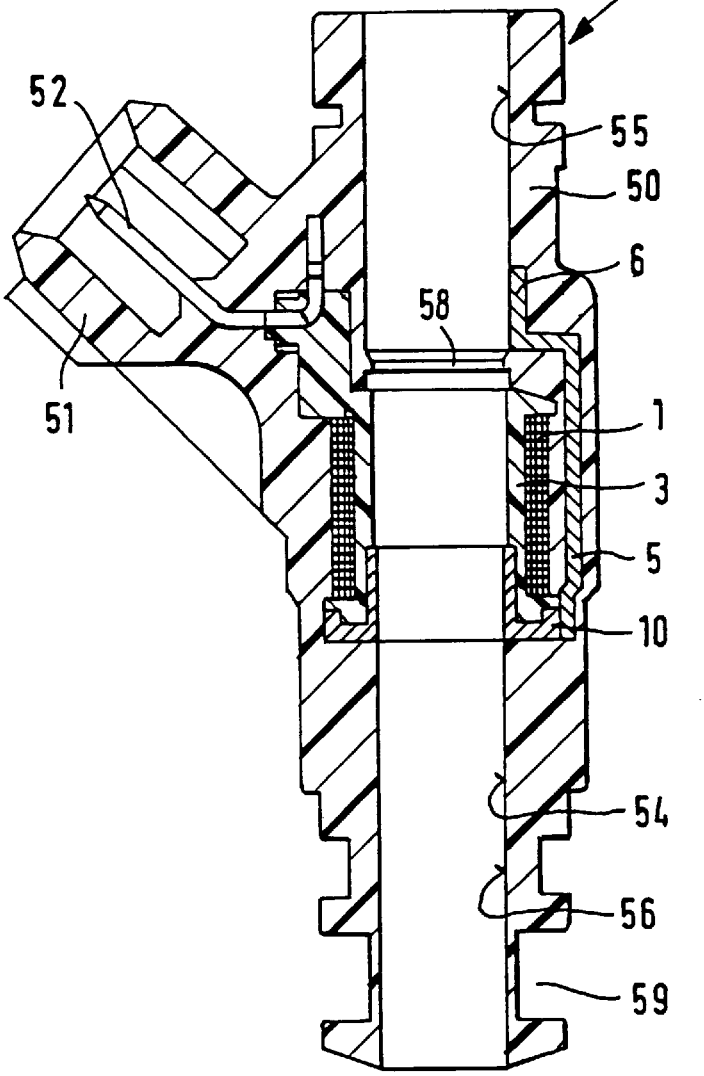
FIG. 2 shows an exemplary outer, tube-shaped plastic part according to the present invention.

FIG. 2 shows an outer, tube-shaped plastic part 60 with the solenoid subassembly that is formed mainly of plastic shroud 50 with connector 51. Plastic part 60 consists specifically of solenoid 1, plastic coil body 3 that holds the windings of solenoid 1, at least one e.g. clip-shaped conductive element 5, conductive ring 10 and plastic shroud 50 that completely surrounds this arrangement which can be identified as the solenoid subassembly outward in the circumferential direction. Tube-shaped plastic shroud 50 includes standard design connector 51 which has, e.g., two contact pins 52 that are used for electrical excitation of solenoid 1. Contact pins 52 extend out of coil body 3 to connector 51.

Plastic shroud 50 is shaped so that it forms inner through opening 54 that runs axially.

Inner through opening 54 of plastic part 60 is not completely determined by the inner diameter of plastic shroud 50, but also by the inner diameter of upper end 6 of conductive element 5, the inner diameter of coil body 3, and the inner diameter of conductive ring 10. According to the minimum differences in inner diameter of components 3, 5 and 10 that were already described, a slightly stepped through opening 54 of plastic part 60 results. Outside the solenoid subassembly, the diameter of through opening 54 is determined by the plastic of the plastic shroud 50, the inner diameter of opening area 55 located upstream of solenoid 1 being greater than the inner diameter of the opening area located downstream of solenoid 1.

Figure 4:
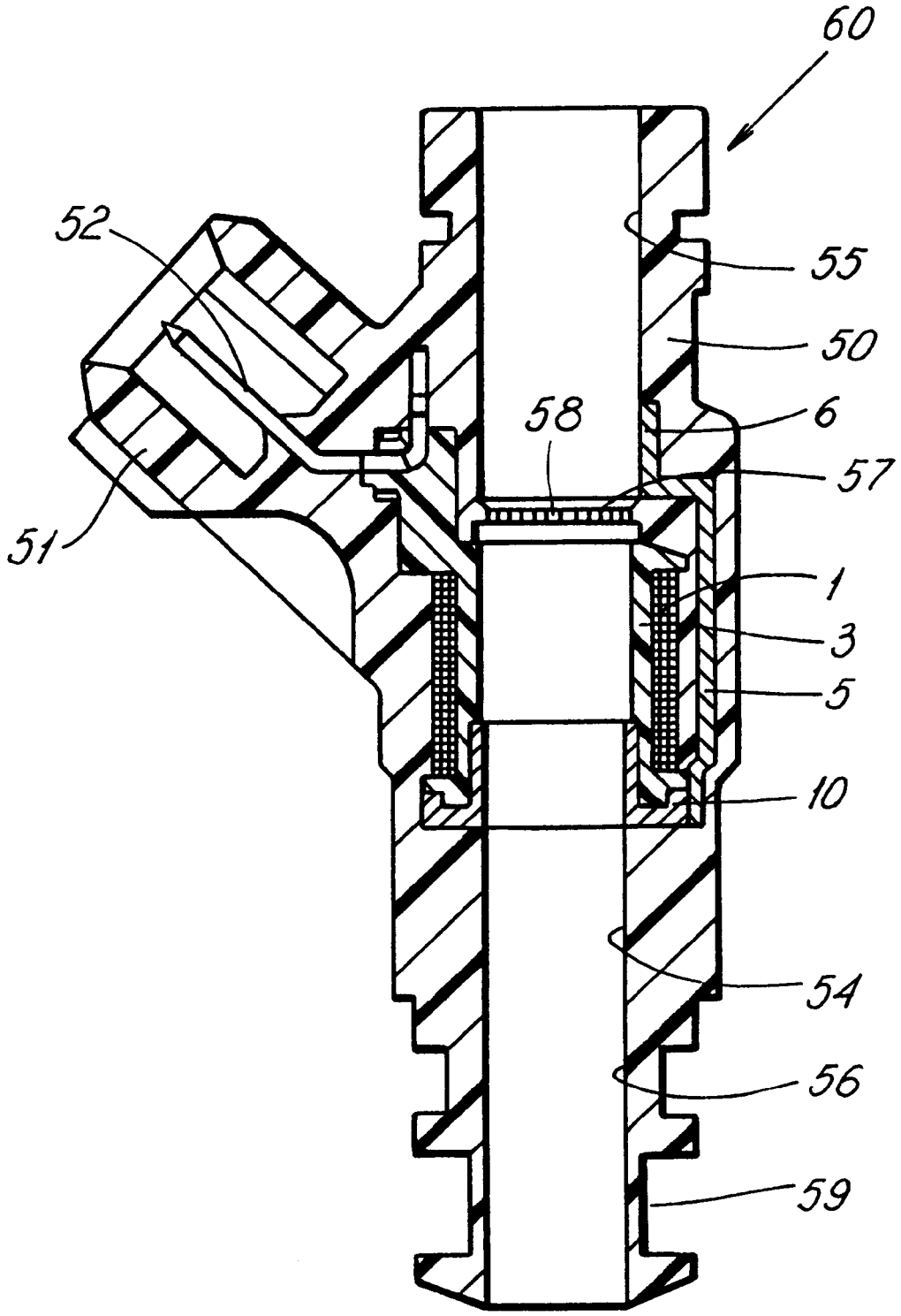
FIG. 4 shows another embodiment of the outer, tube-shape plastic part according to the present invention.

The plastic shroud 50 surrounds the solenoid subassembly not only in the circumferential direction and in the axial direction but it also extends in the area of the conductive element 5 and between the conductive element 5 and solenoid 1, i.e. coil body 3. Immediately above coil body 3, plastic shroud 50 is designed at through opening 54 in such a way that holding element 58 that extends into through opening 54, and, e.g., encircles it 360° somewhat reduces the cross section of through opening 54. This holding element 58 can be designed in the form of a surrounding tab, an inner bead and/or an inner collar and have an angular or rounded contour. Also, several holding tabs 57 (as shown in FIG. 4) arranged around the circumference of the through opening 54 are conceivable. The outer contour of plastic shroud 50 is adapted to the desired installation conditions, with a ring groove 59, into which sealing ring 62 can be installed (FIG. 1) being provided, e.g., on the lower end of plastic shroud 50.

The design of such a plastic part 60 with holding element 58 according to FIG. 2 makes possible a novel and simplified assembly for fuel injection valves. The parts that conduct the magnetic flux, conductive element 5 and conductive ring 10, are first connected tightly to coil body 3 with solenoid 1, for example by a clip connection or by weld points. This solenoid subassembly is subsequently coated with plastic so that the contour of plastic part 60, which has already been extensively described, is developed. In this process, inner through opening 54 is obtained by placing a mandrel in the plastic injection molding tool; said mandrel simulates an inner valve part 70 shown in FIG. 3.

Figure 3:
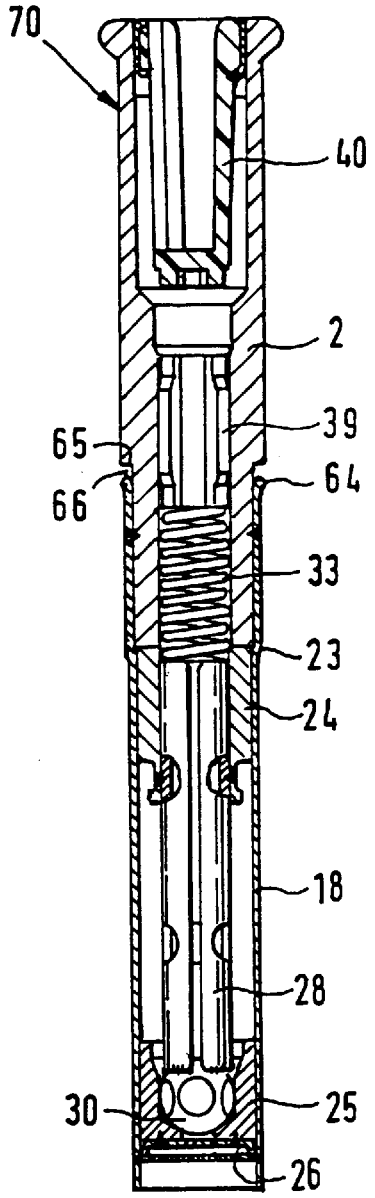
FIG. 3 shows an exemplary inner valve part according to the present invention.

Valve part 70 shown in FIG. 3 that is manufactured and adjusted separately from plastic part 60 corresponds to the inner subassembly of the fuel injection valve shown in FIG. 1. Valve part 70 comprises mainly the core 2, fuel filter 40, adjusting sleeve 39, restoring spring 33, valve needle 28 with valve closing body 30, armature 24, sleeve 18 and valve seat body 25 with injection hole disk 26. The individual components work together in the manner described above and are connected to each other according to explanations already given with regard to FIG. 1.

By using the relatively inexpensive sleeve 18, it is possible to eliminate the usual rotary parts in injection valves like valve seat carriers or nozzle holders, which because of their greater outer diameter are more voluminous and more expensive to manufacture than sleeve 18. Thin-walled sleeve 18 (wall thickness, e.g., 0.3 mm) is manufactured, for example by deep-drawing, using a non-magnetic material, e.g., a rust-resistant CrNi steel. As already mentioned, because of its large extension, sleeve 18 that is present as a sheet metal deep-drawn part holds valve seat body 25, injection hole disk 26, valve needle 28 with armature 24, restoring spring 33 and at least partially, core 2 and as a result also the contact area of armature 24 and core 2 to limit the stroke. On its upper axial end, sleeve 18 has, e.g., a surrounding edge 64 that is bent slightly outward. Surrounding edge 64 is formed through the separation of material overflow during deep drawing and is used to produce a secure holding connection in the injection valve.

After stroke adjustment and assembly of the individual components to valve part 70, the complete valve part 70 is slid into through opening 54 of plastic part 60 from upper opening area 55. If the insertion length is appropriate, valve part 70 and plastic part 60 are firmly held together. This is accomplished in that holding element 58 of plastic part 60 engages in groove 66 between surrounding edge 64 of sleeve 18 and outer core shoulder 65. This can involve engagement, latching or clipping. Groove 66 can also be designed at a different place on the circumference of core 2. The geometries of holding element 58 and groove 66 can be provided so that an absolutely secure, slip-free connection occurs, such that it is no longer possible to loosen the connection without tools. This type of assembly has the great advantage that the extrusion-coating pressure (up to 350 bar) required during the plastic coating process cannot lead to deformation of thin-walled sleeve 18, since sleeve 18 is only subsequently integrated with the entire valve part 70 in plastic part 60.

What is claimed is:

1. A fuel injection valve for an internal combustion engine having a longitudinal valve axis, comprising:

an independently manufactured outer portion having an inner through opening and including a solenoid, at least one conductive element for closing an electromagnetic circuit, an electrical terminal and a plastic shroud, wherein the plastic shroud at least partially surrounds the solenoid, the electrical terminal and the at least one conductive element; and an independently manufactured valve portion including a tube-shaped core, a valve needle, and a valve closing body integrally connected to the valve needle, a valve seat provided on a valve seat body, and a thin-walled axially extending, non-magnetic sleeve, wherein within the thin-walled axially extending, non-magnetic sleeve, the valve needle and the valve closing body move axially along the longitudinal valve axis, wherein the thin-walled axially extending, non-magnetic sleeve is fixed tightly to the core delimiting an outside of the valve portion, and wherein the valve portion is insertable in the inner through opening of the outer portion and is tightly connected to the outer portion via at least one holding connection, the at least one holding connection connecting, on the one hand, the valve portion and, on the other hand, the outer portion including the solenoid integrated within the outer portion.

2. The fuel injection valve according to claim 1, wherein the at least one holding connection is provided within the inner through opening of the outer portion.

3. The fuel injection valve according to claim 1, wherein a circumference of the valve portion has at least one groove.

4. The fuel injection valve according to claim 3, wherein the outer portion includes at least one holding element, and wherein the at least one holding connection can be produced by one of engaging, latching and clipping the at least one holding element to the at least one groove.

5. The fuel injection valve according to claim 4, wherein the at least one holding element includes at least one holding tab extending into and encircling the inner through opening of the outer portion.

6. The fuel injection valve according to claim 4, wherein the at least one holding element includes a plurality of holding tabs arranged around a circumference of the inner through opening of the outer portion.

7. The fuel injection valve according to claim 3, wherein the thin-walled axially extending, non-magnetic sleeve includes a surrounding edge at an end for partially delimiting the at least one groove on the circumference of the valve portion.

8. The fuel injection valve according to claim 3, wherein the at least one groove is provided on a circumference of the tube-shaped core.

9. The fuel injection valve according to claim 1, wherein the thin-walled axially extending, non-magnetic sleeve is a deep-drawn sheet metal part.

10. The fuel injection valve according to claim 1, wherein the valve portion is tightly connected to the thin-walled axially extending, non-magnetic sleeve for an entire length of the thin-walled axially extending, non-magnetic sleeve.

11. The fuel injection valve according to claim 1, wherein the valve portion is inserted in the inner through opening of the outer portion via an upper opening area of the inner through opening, the upper opening area being situated in a fuel receiving end of the valve portion.

12. The fuel injection valve according to claim 1, wherein, in both an unassembled state and an assembled state, the solenoid is integral with the plastic shroud.

13. The fuel injection valve according to claim 1, wherein the at least one holding connection is situated between the solenoid and the plastic shroud.

14. A process for manufacturing a fuel injection valve arranged along a longitudinal valve axis, comprising the steps of:

independently manufacturing an outer portion of the valve having an inner through opening and including a solenoid, at least one conductive element for closing an electromagnetic circuit, an electrical terminal and a plastic shroud, wherein the plastic shroud at least partially surrounds the solenoid, the electrical terminal and the at least one conductive element;

independently manufacturing a valve portion of the valve including a tube-shaped core, a valve needle, and a valve closing body integrally connected to the valve needle, a valve seat provided on a valve seat body, and a thin-walled axially extending, non-magnetic sleeve, wherein within the thin-walled axially extending, non-magnetic sleeve, the valve needle and the valve closing body move axially along the longitudinal valve axis, wherein the thin-walled axially extending, non-magnetic sleeve is fixed tightly to the core delimiting an outside of the valve portion;

inserting the valve portion into the inner through opening of the outer portion; and using at least one holding connection, joining, on the one hand, the valve portion and, on the other hand, the outer portion including the solenoid integrated within the outer portion.

15. The process according to claim 14, wherein the at least one holding connection is produced by one of engaging, latching and clipping the valve portion in the outer portion.

16. The process according to claim 4, wherein, in the inserting step, the valve portion is inserted into the inner through opening of the outer portion via an upper opening area of the inner through opening, the upper opening area being situated in a fuel receiving end of the valve portion.

* * * * *

UNITED STATES PATENT AND TRADEMARK OFFICE

CERTIFICATE OF CORRECTION

PATENT NO. : 6,012,655
DATED : January 11, 2000
INVENTOR(S) : Stefan Maier

It is certified that error appears in the above-identified patent and that said Letters Patent is hereby corrected as shown below:

Abstract [57],
Lines 3 and 12, change "value" to -- valve --;

Column 1,
Lines 8-9, insert -- BACKGROUND INFORMATION --;
Line 51, delete "present" and after "the" insert -- present --;

Column 2,
Line 60, delete "upper";
Line 63, change "tubeshaped" to -- tube-shaped --;

Signed and Sealed this

Twenty-first Day of August, 2001

*Attest:*

Nicholas P. Godici

NICHOLAS P. GODICI
*Acting Director of the United States Patent and Trademark Office*

*Attesting Officer*